US011425952B2

(12) United States Patent
Handfield et al.

(10) Patent No.: US 11,425,952 B2
(45) Date of Patent: Aug. 30, 2022

(54) HELMET WITH CHEEK PADS AND METHOD FOR THE USE THEREOF

(71) Applicant: Kimpex Inc., Drummondville (CA)

(72) Inventors: Robert Handfield, St-Lucien (CA); Nicolas Bouchard-Fortin, Racine (CA)

(73) Assignee: KIMPEX INC., Drummondville (CA)

( * ) Notice: Subject to any disclaimer, the term of this patent is extended or adjusted under 35 U.S.C. 154(b) by 287 days.

(21) Appl. No.: 16/601,266

(22) Filed: Oct. 14, 2019

(65) Prior Publication Data

US 2020/0093214 A1 Mar. 26, 2020

Related U.S. Application Data

(63) Continuation-in-part of application No. 15/397,563, filed on Jan. 3, 2017, now abandoned.

(51) Int. Cl.
*A42B 3/08* (2006.01)

(52) U.S. Cl.
CPC ..... *A42B 3/08* (2013.01)

(58) Field of Classification Search
CPC .. A42B 3/24; A42B 3/245; A42B 3/28; A42B 3/326
See application file for complete search history.

(56) References Cited

U.S. PATENT DOCUMENTS 3,311,922 A * 4/1967 Bezzerides ..... A61F 9/06 2/8.1
3,838,466 A * 10/1974 Poirier ..... A42B 3/24 2/10
4,612,675 A * 9/1986 Broersma ..... A42B 3/12 2/171.3
4,729,132 A * 3/1988 Fierro ..... A42B 3/285 2/171.2
5,161,261 A * 11/1992 Kamata ..... A42B 3/24 2/424
5,170,510 A * 12/1992 Nava ..... A42B 3/24 2/171.3
5,212,843 A * 5/1993 Kamata ..... A42B 3/06 2/171.3
5,313,670 A * 5/1994 Archer, III ..... A41D 13/018 2/410
5,329,641 A * 7/1994 Kalhous ..... A42B 3/105 2/422

(Continued)

*Primary Examiner* — Shaun R Hurley
*Assistant Examiner* — Bao-Thieu L Nguyen
(74) *Attorney, Agent, or Firm* — Brouillette Legal Inc.; Robert Brouillette

(57) ABSTRACT

A helmet having a cheek pad is provided. The helmet for use with the cheek air pad includes an outer shell having an inside surface, an inner liner surrounding the head of the user and operatively mounted to the helmet outer shell, a chin bar disposed below the face visor, the chin bar having an inside surface facing toward the person when wearing the helmet and a breath guard. The inner liner generally has an inner face and a transparent face visor is attached to the helmet outer shell. The cheek pad is preferably embodied as a deformable element extending upwardly and/or inwardly from the helmet inner liner on the right and/or left inner side of the face visor or goggles. The deformable element is configured to be in contact with the face of the user and the inner edge of the breath guard and the inner liner.

13 Claims, 6 Drawing Sheets

(56) References Cited

U.S. PATENT DOCUMENTS

| | | | | |
|---|---|---|---|---|
| 5,349,949 | A * | 9/1994 | Schegerin | A62B 18/08 128/201.24 |
| 6,418,564 | B1 * | 7/2002 | Sheridan | A42B 3/0486 2/410 |
| 6,742,192 | B1 * | 6/2004 | Song | A42B 3/24 2/422 |
| 6,748,607 | B1 * | 6/2004 | Hong | A42B 3/10 2/422 |
| 7,854,023 | B2 * | 12/2010 | Ando | A42B 3/127 2/414 |
| 8,756,715 | B1 * | 6/2014 | Moffitt, Jr. | A42B 3/24 2/171.3 |
| 2003/0070200 | A1 * | 4/2003 | Crye | F41H 1/04 2/6.6 |
| 2008/0172778 | A1 * | 7/2008 | Lysogorski | A61F 9/028 2/436 |
| 2009/0031483 | A1 * | 2/2009 | Wallerberger | A42B 3/326 2/421 |
| 2012/0000011 | A1 * | 1/2012 | Grewall | A42B 3/328 2/421 |
| 2012/0317705 | A1 * | 12/2012 | Lindsay | A42B 3/20 2/413 |
| 2014/0020158 | A1 * | 1/2014 | Parsons | A42B 3/121 2/413 |
| 2014/0201890 | A1 * | 7/2014 | Kelly | A42B 3/122 2/413 |
| 2015/0196080 | A1 * | 7/2015 | Handfield | A42B 3/24 2/422 |
| 2017/0196294 | A1 * | 7/2017 | Fischer | A42B 3/328 |
| 2017/0224043 | A1 * | 8/2017 | Bouchard-Fortin | A42B 3/205 |
| 2017/0367432 | A1 * | 12/2017 | Handfield | A42B 3/326 |
| 2018/0295926 | A1 * | 10/2018 | Bouchard Fortin | A42B 3/24 |

* cited by examiner

HELMET WITH CHEEK PADS AND METHOD FOR THE USE THEREOF

CROSS-REFERENCE TO RELATED APPLICATION

This application is a continuation-in-part of U.S. application Ser. No. 15/397,563 filed on Jan. 3, 2017.

FIELD OF THE INVENTION

The present invention generally relates to helmet for motor vehicles and motorsports, particularly to an internal helmet padding for mounting onto an inner side of an impact absorbing liner in the helmet to prevent water vapour from reaching the visor.

BACKGROUND OF THE INVENTION

A safety helmet for riding a vehicle is constituted by fitting an impact absorbing liner comprising styrene foam or the like to an inner side of an outer shell and fixedly adhering an interior body (cushion pad) formed by covering a surface of a cushion material made of foamed urethane or the like by a cloth compatible with the skin at a predetermined portion on an inner side of the impact absorbing liner.

The interior body impact absorbing liner, is usually constituted by forming a core material of a rigid plate in a ring-like shape and by covering it with a cushion material which is itself covered by a cloth in those areas which are in direct contact with a human head.

The difference between a high quality helmet and a lower quality helmet often resides in the ability of the helmet to control visor or goggle fogging. Fogging is generally mitigated by controlling the circulation of air containing water vapour within the helmet, particularly by creating a hermetic breath box. Known helmets often comprise breath guards to aid in limiting the user's breath vapor from flowing upwardly and reaching the helmet visor or goggles. Breath guards are useful but lack the ability to provide an adequate fit for several users in part due to the particular configuration of such users' head, cheeks, nose and/or chin. Particularly, it has been found that breath vapor may flow between the breath guard and the inner liner about the user's cheeks (See element 320, FIGS. 1 and 2).

Even in the presence of a high quality helmet equipped with a good breath guard, it remains that breath vapor is still able to reach the helmet's visor or goggles. Some helmet have gone all the way to providing a sealed breath box where the user needs to wear an air mask for optimal breath control.

However, air masks are known to be of lower comfort to the user. Furthermore, not all users desire having an air mask on their face while wearing a helmet. There is thus a need for a helmet that has an improved breath box for breath control while limiting the need for the user to wear an air mask.

SUMMARY OF THE INVENTION

The shortcomings of the prior art are generally mitigated by providing a helmet comprising a deformable cheek cushion or pad between the helmet cushion pad or inner liner and the breath guard.

According to an aspect of the present invention, it is disclosed a cheek cushion or pad for a helmet. The helmet for use with the cheek pad generally comprises an outer shell, an inner liner, a substantially transparent face visor, a chin bar and a breath guard. The outer shell generally has an inside surface facing a head of a person when wearing the helmet. The inner liner generally surrounds the head of the user when wearing the helmet and is mounted to the helmet outer shell. The inner liner generally has an inner face forming a curved surface for receiving the head of the user when wearing the helmet. The face visor is preferably substantially transparent and attached to the helmet outer shell. The chin bar is disposed below the face visor. The chin bar generally has an inside surface facing toward the person when wearing the helmet. The breath guard generally extends from the inside surface of the chin bar toward the face of the user when wearing the helmet forming a breath guard face edge. The cheek pad preferably is a deformable element extending upwardly and/or inwardly from the helmet inner liner on the right or left inner side of the face visor, the deformable element being configured to be in contact with the face edge of the breath guard and the inner liner so as to block the passage of water vapour laden air between.

According to an aspect of the present invention, there is disclosed a cheek pad that is cushioned between an helmet breath guard, the helmet inner liner and the face of a user when wearing the helmet. The cheek pad is preferably made from a deformable material capable of adapting to the shape of the user's face.

According to an aspect of the present invention, there is disclosed a cheek pad made from polymeric materials.

According to an aspect of the present invention, the cheek pad is configured to improved air control within the helmet breath box. The cheek pad aims at reducing breath vapor flow from the helmet breath box to the goggles or face visor, thus preventing the formation of fogging. As such, the cheek pad in combination with the helmet breath guard and the inner liners aims at constraining the user's breath vapor in the helmet breath box.

The cheek pad is preferably embodied as a deformable element extending upwardly and/or inwardly from the helmet inner liner on the right and/or left inner side of the face visor or goggles. The deformable element is configured to be in contact with the face of the user and the inner edge of the breath guard and the inner liner.

According to an aspect of the present invention, there is disclosed a method of mitigating the displacement of breath vapor flow from the breath box to the helmet visor or goggles. The method comprising the step of inserting a cheek pad between the breath guard and inner liner while preferably continuously maintaining contact with the user's face when wearing the helmet.

Other and further aspects and advantages of the present invention will be obvious upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

The above and other aspects, features and advantages of the invention will become more readily apparent from the following description, reference being made to the accompanying drawings in which.

DETAILED DESCRIPTION OF THE PREFERRED EMBODIMENT

Figure 1:
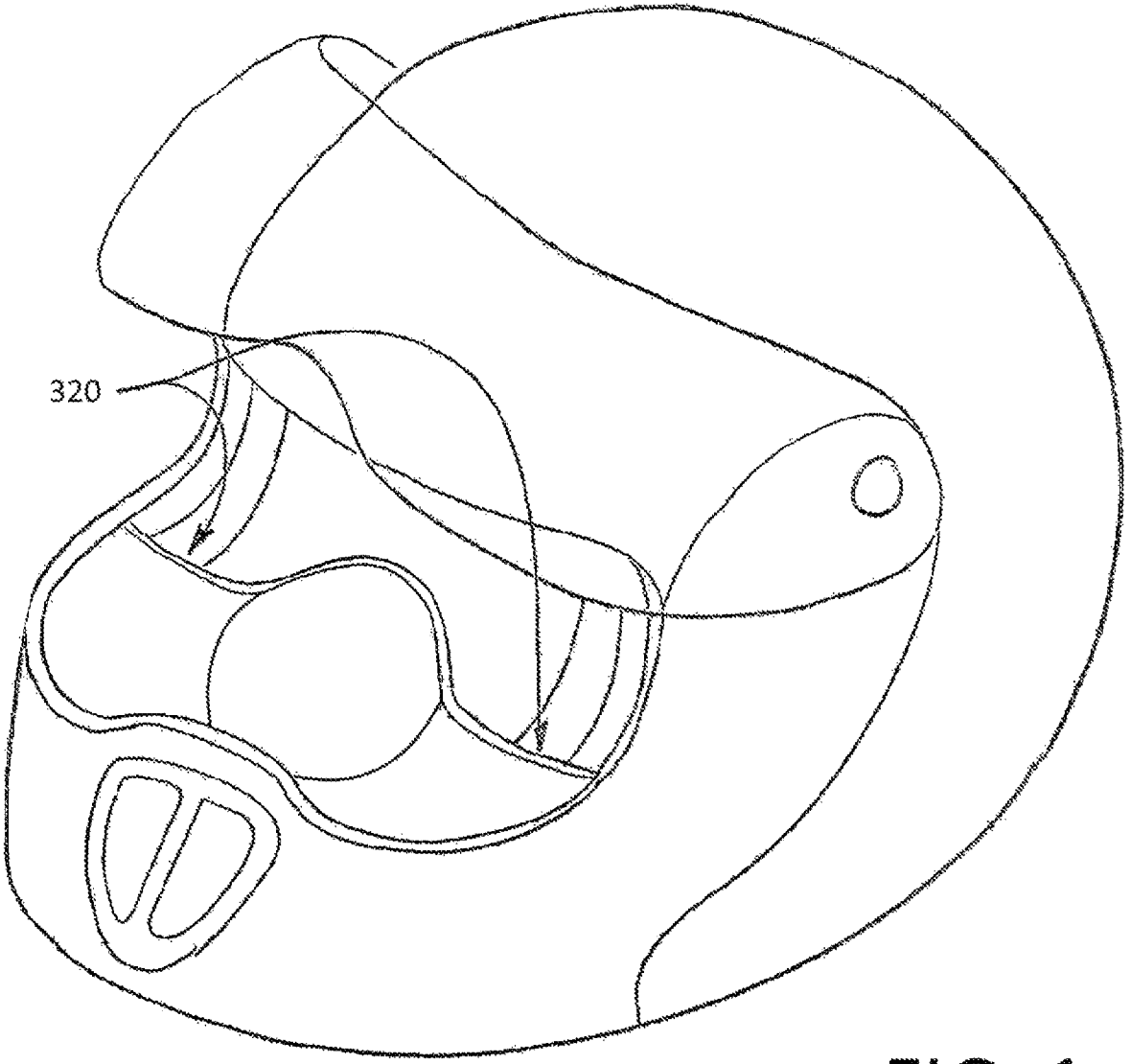
FIG. 1 is a front perspective view of a prior art helmet.
Figure 2:
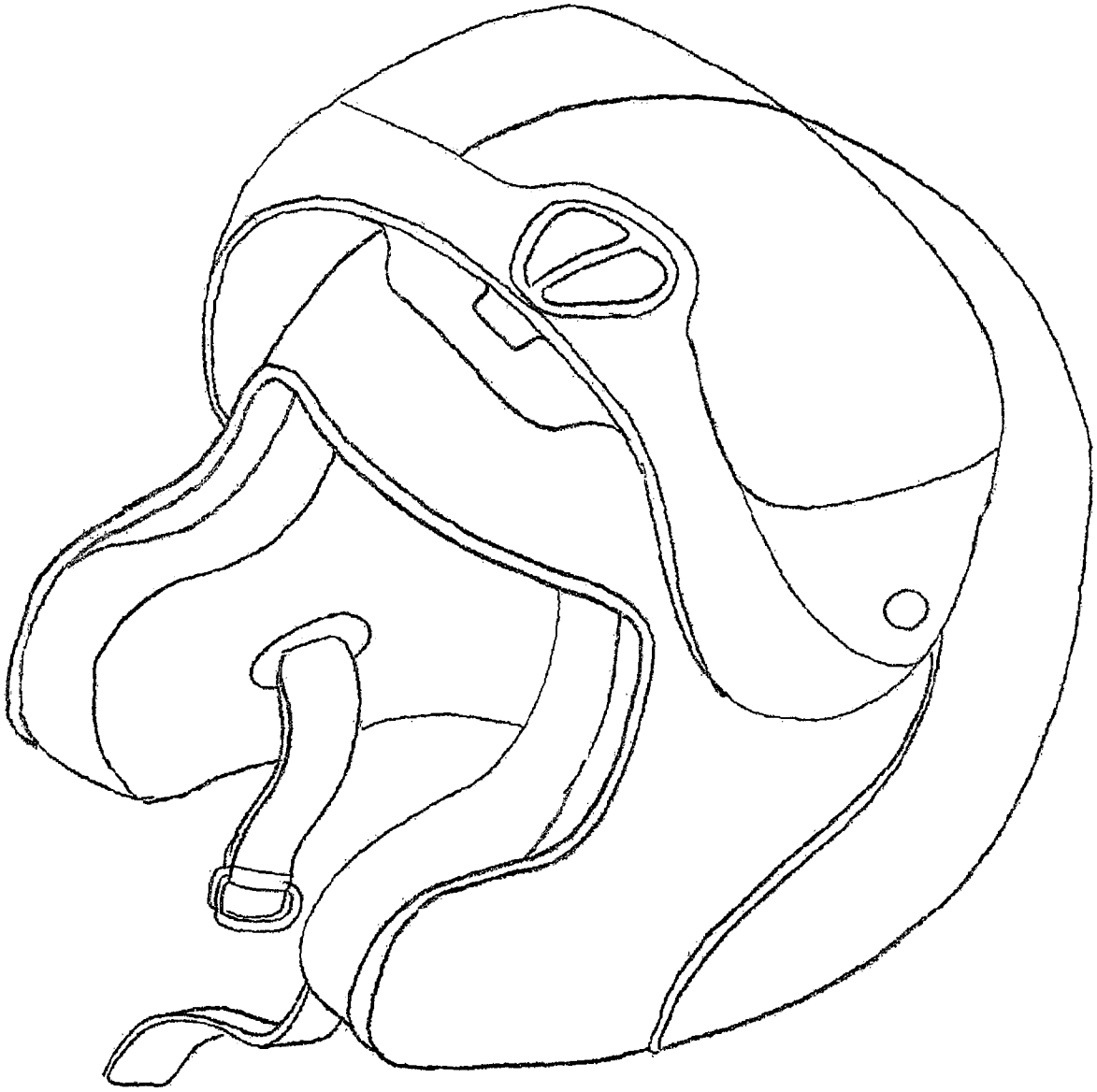
Prior Art Fig 2
FIG. 2 is a front perspective view of the prior art helmet of FIG. 1 wherein the chin bar is raised.

A novel helmet 100 comprising a cheek pad sitting on the interior liner 108 of helmet 100 and method of controlling air vapor in helmets will be described hereinafter.

Although the invention will be described in terms of specific illustrative embodiments, it is to be understood that the embodiments described herein are by way of example only and that the scope of the invention is not intended to be limited thereby.

Definitions

Unless specified otherwise, the use of the term 'helmet' herein refers to helmets for motor vehicle such as UTV, ATV, OHV, snowmobile, motocross and the like. Helmets used broadly includes full face type helmets and modular helmet, full face having a rotatably mounted chin bar 104 with a visor 106 or goggles mounted thereto. Though the invention may be used with motocross type ("MX helmets") the use of the term 'helmet' should not be understood as referring only to MX helmets unless specified as such.

General Description

According to an embodiment, now referring to FIGS. 3-6, the cheek pad 210, 220 is shown mounted to a helmet 100. Helmet 100 generally comprise an outer shell 102, an inner liner 108, a substantially transparent face visor or goggles 106, a chin bar 104, a breath guard 120 and a chin strap 114 for securing the helmet 100 to the user's head. The helmet's 100 outer shell 102 generally has an inside surface 132 facing a head of a person when wearing the helmet 100 and an outer side 134 facing outwardly. The inner liner 108 is typically configured to surround the head of the user when wearing the helmet 100 with right and left front portion 110, 112 extending below the visor 106 opening 130. The inner liner 108 is mounted to the helmet outer shell 102, the inner liner 108 having an inner face 136 forming a curved surface for receiving the head of the user when wearing the helmet 100. The inner liner 108 in combination with the outer shell 102 aims at mitigating the impacts sustained by the helmet 100 wearer. The substantially transparent face visor 106 sometimes referred to as goggles is generally rotatably secured to the helmet outer shell 102 using the rotation element 116 or in modular helmet 100, attached to the chin bar 104 with rotating element 116 and rotating therewith. The chin bar 104 is generally disposed below the face visor 106. The chin bar 104 having an inside surface 138 facing toward the person when wearing the helmet 100. The breath guard 120 generally extends from the inside surface of the chin bar 104 toward the face of the user when wearing the helmet 100 forming a breath guard 120 face edge 150.

The cheek pads 210, 220 are generally made from a deformable element which in use extends upwardly and/or inwardly from the helmet inner liner 108 on the right or left inner side of the face visor. The cheek pads are configured to be in contact with the face edge 150 of the breath guard 120 and the helmet's inner liner 108 as well as with the user's cheek.

The cheek pads could also be integral with the inner liner 108 but should preferably be made of a less rigid material.

Description of an Embodiment of the Cheek Pad

Figure 3:
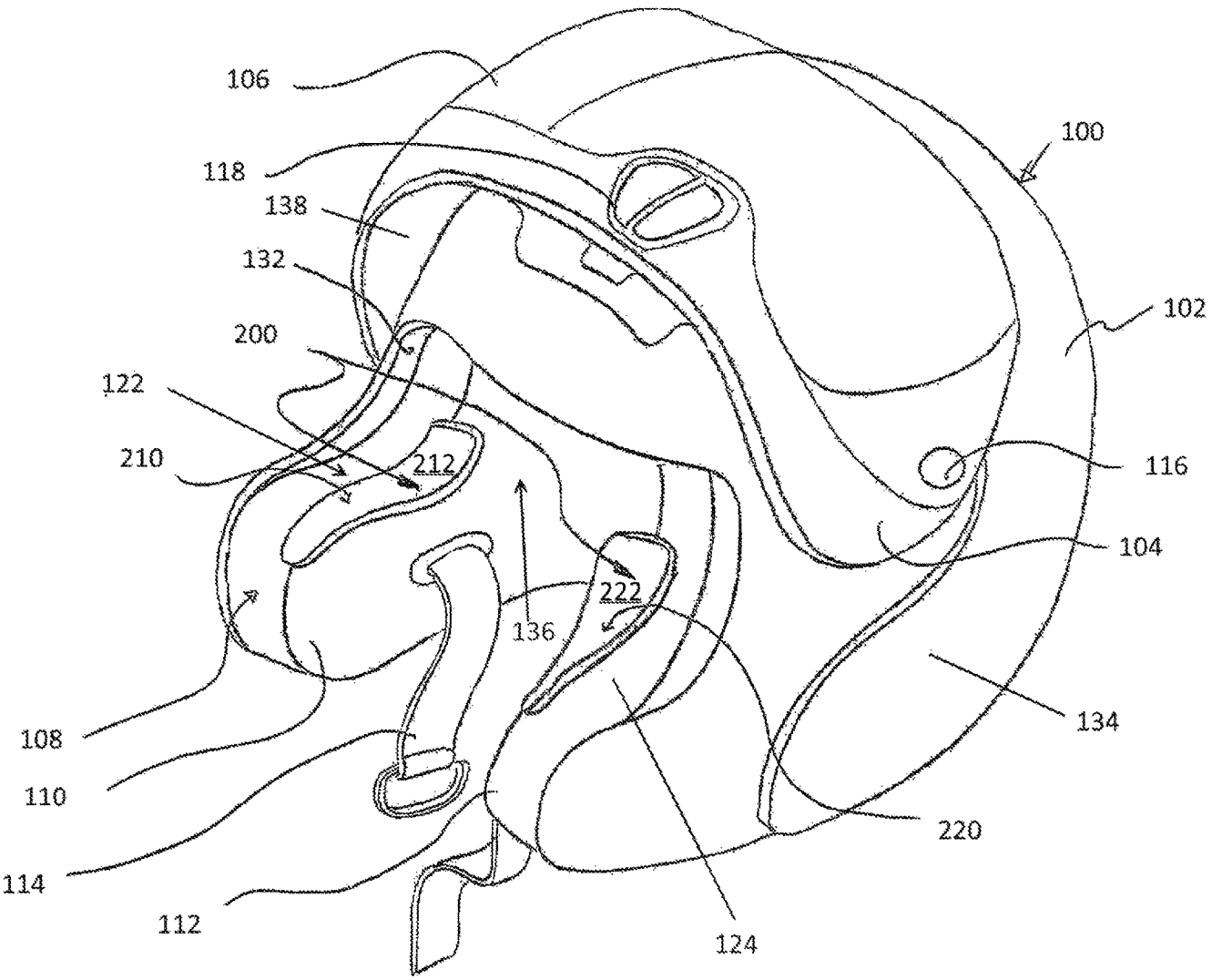
FIG. 3 is a front perspective view of an helmet having the chin bar and visor raised according to an embodiment of the present invention.

In the present embodiment, still referring to FIG. 3, the cheek pads 210, 220 are shown mounted in a modular type helmet 100, a helmet 100 having a chin bar 104 rotatably mounted to the helmet outer shell 102, the chin bar 104 having the visor 106 rotatably mounted thereto and rotating therewith. In modular helmets 100, upward movement of the chin bar 104 clears the face of the user when wearing the helmet 100. As such, upward movement of the chin bar 104 entails upward movement of the visor 106 mounted thereto. According to embodiment of the present invention, the cheek pads 210, 220 are positioned upwardly and/or inwardly on the interior edge 122, 124 of the inner liner 108 on the right and/or left inner side of the face visor about the upper portion 140 of the chin bar 104 and lower portion of the visor 106 opening.

According to an embodiment, in use, the cheek pads 210, 220 are configured to be compressed between the face edge 150 of the breath guard 120 and the upper surface 122, 124 of the inner liner 108 and the face of the user when wearing the helmet 100 limiting the ability of breath vapor to reach the visor 106 and condense thereon.

Description of the Air Pad System

According to an embodiment, the cheek pads 210, 220 are used as a pair to for a vapour barrier system 200 extending between the face of the user and the helmet. The vapour barrier system 200 generally comprises a pair of right and left control pads 210, 220 for mitigating the breath vapor flow to the visor 106 or goggles thus reducing the occurrences of fogging in the visor 106 or goggles. The right and left cheek pads 210, 220 are preferably located on the right and left sides of the helmet 100 about the inner liner 108 in proximity to the user's cheeks when wearing the helmet 100. According to the preferred embodiment, the right and left cheek pads 210, 220 are generally respectively in contact with the user's right and left cheeks when wearing the helmet 100. In addition, the right and left cheek pads 210, 220 are in contact with the helmet 100 breath guard 120. According to the preferred embodiment, the right and left cheek pads 210, 220 are in contact with the breath guard's 120 face edge 150.

Other embodiments of the cheek pad system 200 for a helmet 100 may have the right and left control pads 210, 220 in contact with the underside 126, 128 of the helmet breath guard 120.

According to an embodiment, the surface of the left and right control pads 210, 220 which is in contact with the breath guard 120 cover around 30% of the total surface of the breath guard 120 defined as being the surface between the outer left side and the outer right side of the breath guard 120.

According to a preferred embodiment of the present invention, the cheek pads 210, 220 are made from air tight fabric or material that once in contact with the user's face and the breath guard 120 seals the breath box and prevent breath vapor from flowing upward and reaching the visor 106. As such, in the preferred embodiment, the breath guard 120, the inner liner 108, the cheek pads 210, 220 and the face of the user form an air tight barrier preventing the upward flow of air to the helmet 100 visor 106.

According to an embodiment, the cheek pads 210, 220 are made from a deformable material covered by a deformable, yet preferably airtight covering material. Understandably, though preferred, air-tight covering fabric is not essential for the cheek pads 210, 220. Other embodiments, could be designed with a material that allows air through in its inoperative state, uncompressed state, but once compressed by both the user face and the breath guard 120 face edge 150, the material is rendered dense enough to prevent the breath vapor from easily flowing through thus providing an adequate level of air blocking ability between the breath guard 120 and the user's face. Yet, the material or fabric used for making the cheek pads 210, 220 should be adequate for skin contact and preferably temperature insensitive, at least for the portion of the cheek pad that is designed to be in contact with the user's face. Understandably, the underside of the cheek pad 210, 220, the portion that is designed to be in contact with the inner liner 108 may be made from other material as to permit adherence to the inner liner 108 when used or sold with or separately as add-ons to an existing helmet 100.

According to an embodiment, the cheek pads 210, 220 may be designed to be attached to an existing helmet 100 post purchase. In such a retrofitting embodiment, the helmet 100 owner would preferably acquire cheek pads 210, 220 having a quick attach securing element. The quick attach element may be any system that allows to retrofit the cheek pads 210, 220 by securing them to the inner liner 108 of an existing helmet 100. A non-limitative example of quick attachment element is the use of Velcro™ elements on the cheek pads 210, 220 and inner liner 108. The Velcro™ elements could be glued, stitched or otherwise attached to the inner liner 108 of the helmet 100 to complement the other the Velcro™ elements positioned on the underside of the cheek pads 210, 220. As such, the underside of the cheek pads 210, 220 could be provided with the hook anchoring element of Velcro™, while the inner liner 108 fabric could act with or without alteration as the softer complementary loop Velcro™ element thus providing the adequate adherence between the helmet inner liner 108 upper edge and the underside of the cheek pads 210, 220.

According to an embodiment, the cheek pads 210, 220 are provided as add-ons to existing helmets 100. The cheek pads 210, 220 may thus be provided in distinct sizes to adapt to the various user face shapes and sizes and provide an alternative to users requiring smaller cheek pads 210, 220 while also obtaining the vapour flow control effect of the cheek pads 210, 220.

According to an embodiment, depending on the size of the inner liner 108, the size of the cheek pads 210 and 220 varies from 20% to 50% of the size of the inner liner 108.

According to an embodiment, there is disclosed a helmet 100 with cheek pads 210, 220 mounted therein. The helmet 100 comprises cheek pads 210, 220 mounted to or integral with the inner liner 108. The cheek pads 210, 220 may be secured to the inner liner 108 by stitching, glue or via any other suitable means of mounting the air control to the inside of the helmet 100 while maintaining its air control ability.

According to yet another embodiment, the cheek pads 210, 220 could be embodied as air pockets made from air tight fabric positioned about the upper edge of the inner liner 108. The cheek pads 210, 220 according to this embodiment could be customized to the user's face shape and size.

Figure 6:
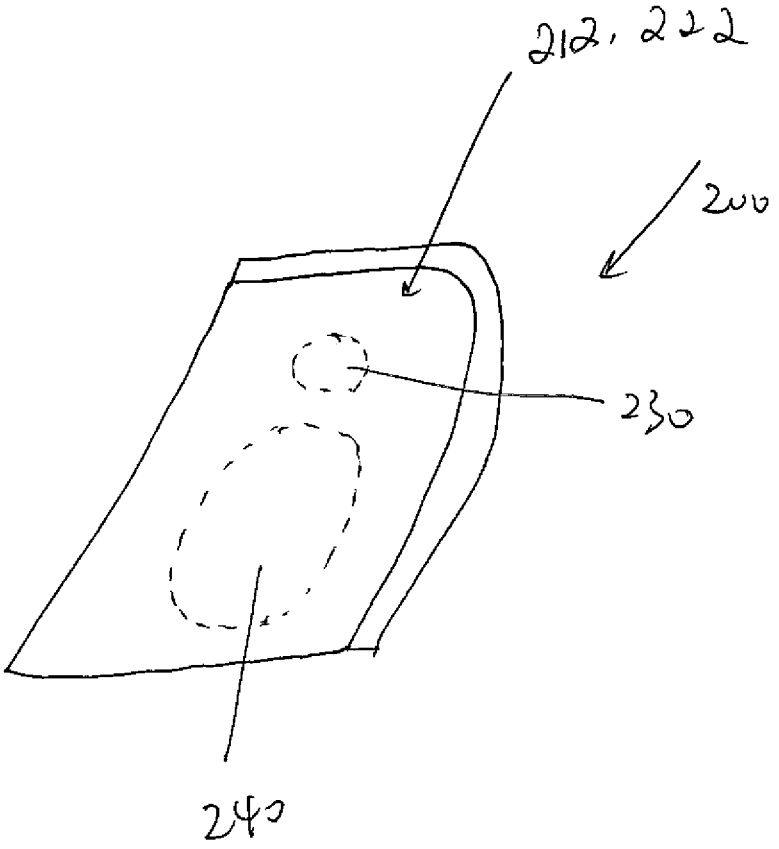
FIG. 6 illustrates an integrated air pump system and a way to have a defined volume while being adapted to adopt different forms.

Other configurations of the cheek pads 210, 220 could have an integrated air pump system 230 to fill the air pocket upon wearing the helmet 100 as shown in FIG. 6. In such an embodiment, securing of the helmet 100 to the user head or lowering of the chin bar 104 could automatically actuate an air pump system 230 in which air is pumped in the air control pads 210, 220 until adequate air control is obtained. The actuation of the air pump system 230 could be automatic or manual. Therefore, some embodiments of the helmet 100 air control pad could have a manual pump for inflating the cheek pads until the user deems the helmet 100 adequately mitigates the breath vapor flow from the user's mouth and/or nose to the visor.

According to yet another embodiment, the cheek pad 210, 220 could be made from mildly compressible, yet deformable material such as gel-like substances that generally occupy a defined volume 240 but which may be deformed to take different form. In such an embodiment, the pressure of the user's face against the cheek pads 210, 220 would deform the gel like cheek pads 210, 220 to adapt them to the user's face, yet allow the cheek pads 210, 220 gel to fill the otherwise unoccupied space between the breath guard 120 and inner liner 108.

According to another embodiment, the cheek pad is configured to be inserted between the breath guard 120 and the inner liner 108 of an MX helmet. According to this embodiment, the cheek pads are designed to control breath vapor from flowing upwardly and potentially generating fogging in the user's visor or goggles. The use of cheek pads may also be desired in MX helmet to increasing the efficiency of an MX helmet breath box. According to an embodiment, the cheek pads 210, 220 outer surface (212, 222) or at least the surface of the cheek pads that is to be in contact with the face of the user when wearing the helmet 100 may be recovered with textile material. Covering the cheek pads 210, 220 with textile may improve the user comfort when wearing the helmet 100.

According to another embodiment, the cheek pads 210 and 220 may be integrated to the breath guard 120, such as but not limited to being mounted to the inside of the chin bar 104.

According to an embodiment of the present invention, a method of using the cheek pads 210, 220 is disclosed. The method comprises the step of upwardly rotating the chin bar 104 to its secured non-operational position. The method further comprises the step of securing a right and a left cheek pads 210, 220 to the right and left upper surface 122, 124 of the inner liner 108 about the portion in contact with the cheek of the user when wearing the helmet 100.

Figure 4:
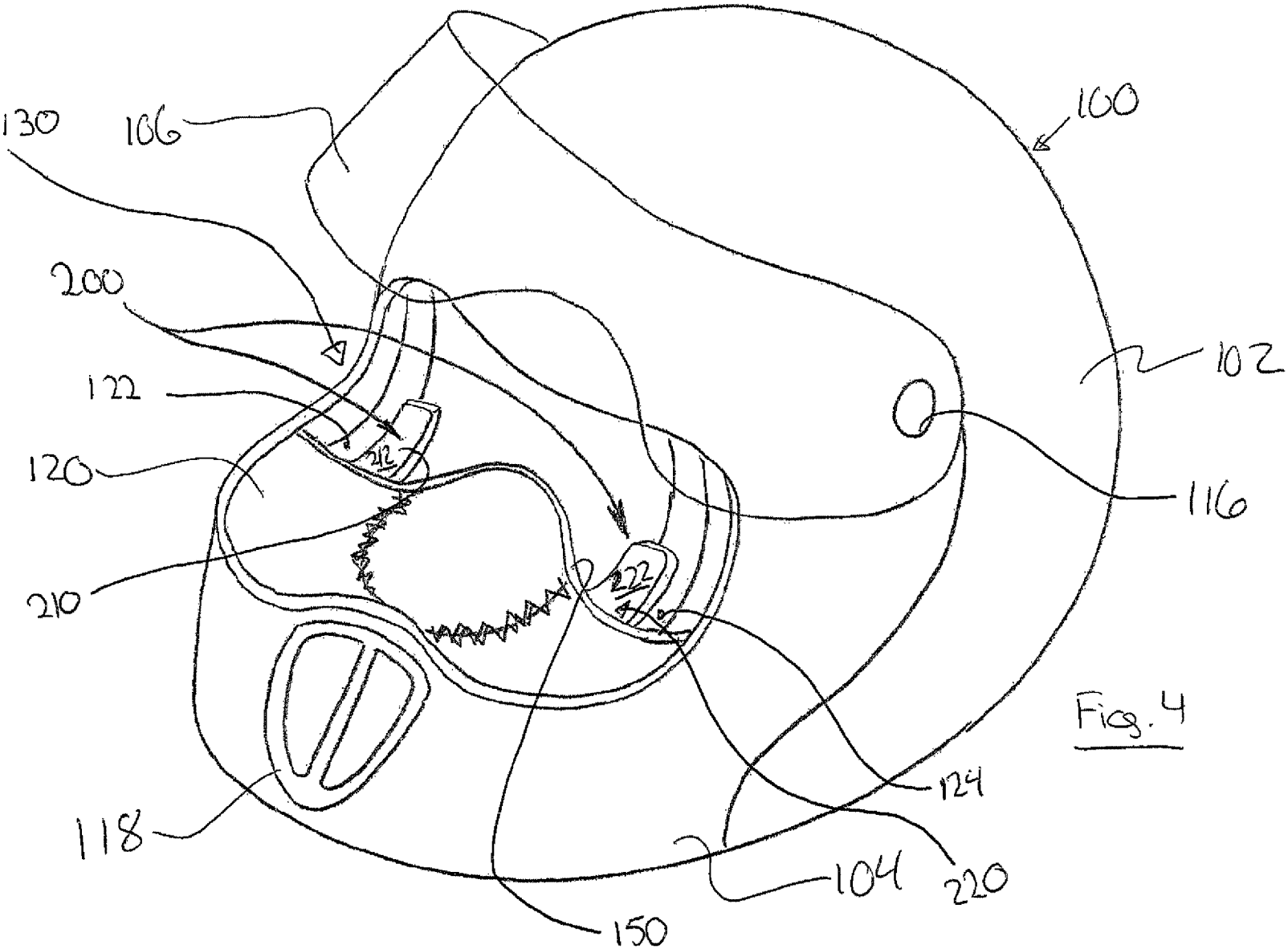
FIG. 4 is a front perspective view of the helmet of FIG. 3, wherein the chin bar is in closed position and the visor is raised.
Figure 5:
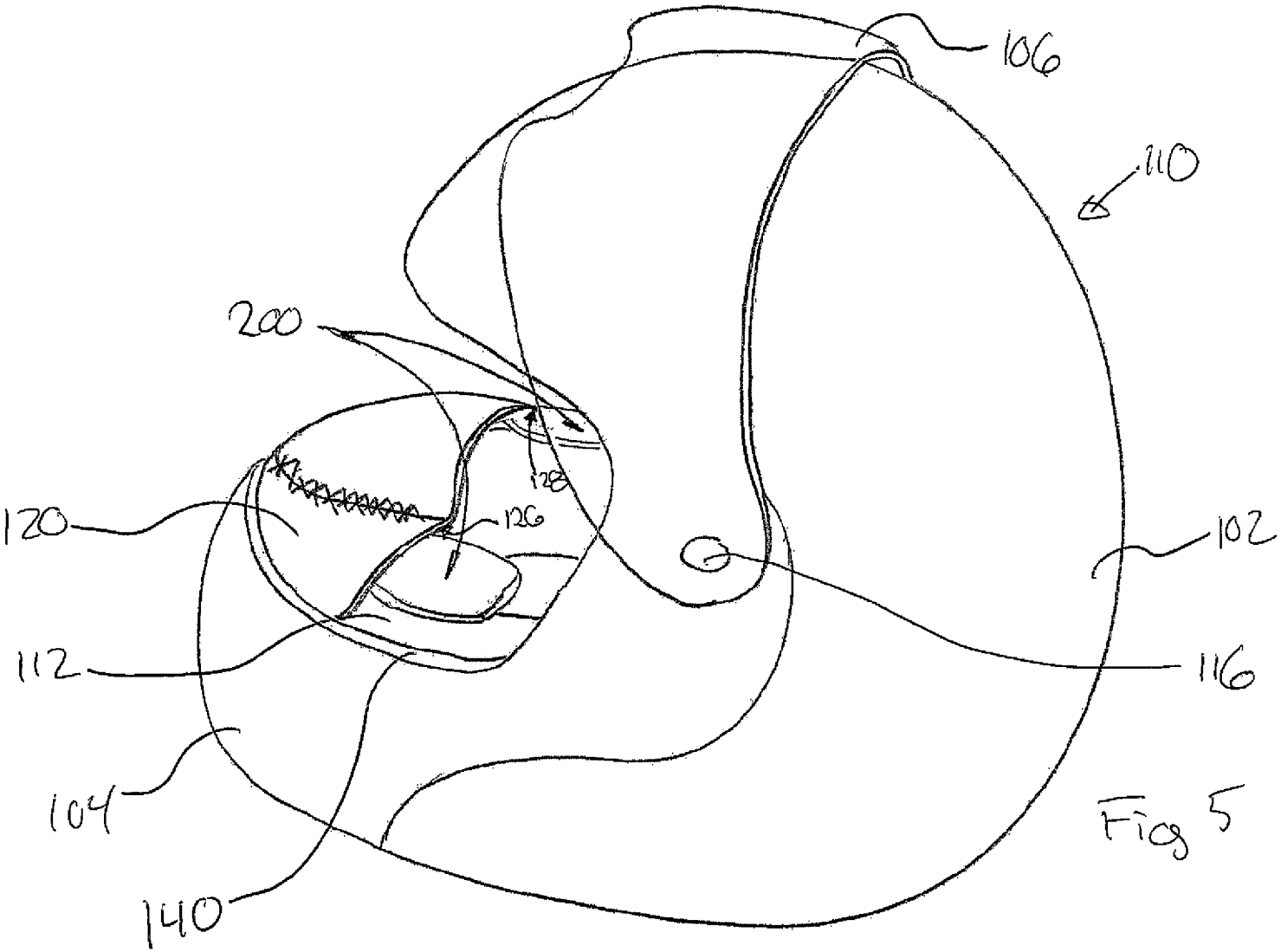
FIG. 5 is a rear perspective view of the helmet of FIG. 4.

The method further comprising the step of downwardly rotating the chin bar 104 to its secured operational position (see FIG. 4).

According to an embodiment, a method of controlling breath vapor flow to the visor is disclosed, the method comprising the step of inserting cheek pads 210, 220 between inner liner 108 on the side facing the head of the user and the breath guard 120 so that it becomes compressed against the user's face when wearing the helmet 100.

While illustrative and presently preferred embodiments of the invention have been described in detail hereinabove, it is to be understood that the inventive concepts may be otherwise variously embodied and employed and that the appended claims are intended to be construed to include such variations except insofar as limited by the prior art.

The invention claimed is:

1. A helmet comprising:

an outer shell having an inside surface for facing a head of a person when wearing the helmet;

an inner liner for surrounding the head of the user when wearing the helmet and mounted to the helmet outer shell, the inner liner having an inner face forming a curved surface for receiving the head of the user when wearing the helmet;

a transparent face visor attached to the helmet outer shell;

a chin bar disposed below the face visor, the chin bar having an inside surface facing toward the user when wearing the helmet; and a breath guard comprising a breath guard face edge which is in contact with the face of the user when wearing the helmet, the breath guard extending from the inside surface of the chin bar toward the breath guard face edge, the helmet further comprising a right cheek pad and a left cheek pad, each cheek pad being made of a deformable element extending upwardly or inwardly from the helmet inner liner on the right and left inner sides of the face visor, the deformable element being configured to be in contact with the face edge of the breath guard and the inner liner, wherein the deformable element is configured to adapts to the shape of the user's face when the helmet is worn by the user, and the breath guard, the inner liner, the left and right cheek pads are configured to form an air tight barrier with the face of the user preventing the upward flow of air to the transparent face visor when the helmet is worn by the user.

2. The helmet of claim 1, the cheek pads being configured to be compressed between the face edge of the breath guard and the upper surface of the inner liner and the face of the user when wearing the helmet limiting the ability of breath vapor to reach the visor.

3. The helmet of claim 1, wherein the cheek pads are an integral part of the helmet.

4. The helmet of claim 3, wherein the cheek pads are an integral part of the breath guard.

5. The helmet of claim 2, the cheek pads being made from a deformable material covered by an airtight covering material.

6. The helmet of claim 1, the cheek pads being removably secured to the inner liner.

7. The helmet of claim 1, the cheek pads being adapted to be removable.

8. The helmet of claim 1, wherein the cheek pads are selected from a plurality of pads having various sizes adapted to fit various shapes and sizes of users' faces.

9. The helmet of claim 1, the cheek pads having an integrated air pump system to fill the air pads upon wearing the helmet.

10. The helmet of claim 1, the cheek pads being made by a compressible material in a way to have a defined volume while being adapted to adopt different forms.

11. The helmet of claim 1, the cheek pads being configured to be compressed between the breath guard and the inner liner of the helmet when worn by a user.

12. A method of using a right cheek pad and a left cheek pad in a helmet to limit breath vapor from reaching a visor of the helmet, the cheek pads being made of a deformable element extending upwardly and/or inwardly from a helmet inner liner on the right or left inner side of a face visor, the deformable element being configured to be in contact with a face edge of a breath guard, the inner liner and the cheeks of a user of the helmet, the method comprising:

upwardly rotating a chin bar of the helmet to its secured non-operational position;

securing the right cheek pad to the right side of the inner liner of the helmet about a portion being in contact with a user's cheek when wearing the helmet;

securing the left cheek pad to the left side of the inner liner of the helmet about a portion being in contact with a user's cheek when wearing the helmet;

downwardly rotating the chin bar of the helmet to its secured operational position;

adapting the shape of the left and right cheek pads to the shape of the user's cheeks;

forming an air tight barrier preventing the upward flow of air to the visor with the breath guard, the inner liner, the left and right cheek pads and the face of the user.

13. The method as claimed in claim 12, the method further comprises the step of inserting the cheek pads between the inner liner of the helmet on the side facing the head of the user and the breath guard such as to be compressed against the user's face when wearing the helmet.

* * * * *